US008684019B1

(12) United States Patent
Hudek et al.

(10) Patent No.: US 8,684,019 B1
(45) Date of Patent: Apr. 1, 2014

(54) CORDLOCK

(71) Applicant: AmbuTech Inc., Winnipeg (CA)

(72) Inventors: Gordon Hudek, Winnipeg (CA); Christopher Schwill, Niverville (CA)

(73) Assignee: Ambutech Inc., Winnipeg (CA)

( * ) Notice: Subject to any disclaimer, the term of this patent is extended or adjusted under 35 U.S.C. 154(b) by 0 days.

(21) Appl. No.: 13/708,467

(22) Filed: Dec. 7, 2012

(51) Int. Cl.
*A45B 9/04* (2006.01)

(52) U.S. Cl.
USPC ..... 135/77; 135/78; 135/86; 135/120.4; 24/128; 24/129 R

(58) Field of Classification Search
USPC ..... 135/114, 120.2, 909, 120.4, 74, 76, 77, 135/78, 86; 24/128, 129 R, 130, 129 B
See application file for complete search history.

(56) References Cited

U.S. PATENT DOCUMENTS

| | | | | | |
|---|---|---|---|---|---|
| 554,943 | A * | 2/1896 | Lust | 24/18 |
| 2,705,015 | A * | 3/1955 | Langlais | 52/632 |
| 2,947,051 | A * | 8/1960 | Johnson | 24/129 B |
| 5,020,192 | A * | 6/1991 | Gerlach | 24/136 R |
| 5,683,199 | A * | 11/1997 | Tehan | 403/314 |
| 5,887,840 | A * | 3/1999 | Hoffman | 248/503 |
| 6,378,168 | B1 * | 4/2002 | Brady et al. | 16/110.1 |

* cited by examiner

*Primary Examiner* — Noah Chandler Hawk
(74) *Attorney, Agent, or Firm* — Dimock Stratton LLP; Etienne de Villiers

(57) ABSTRACT

A cordlock of a mobility cane is provided including a body having a length greater than the inner diameter, a width less than the inner diameter, a depth less than the inner diameter, and a body opening extending through the depth and sized to accommodate the cord but to prevent passage of the widened portion. The depth of the body sized to accommodate the cord between the body and the inner wall when the cordlock is inserted in the cane.

20 Claims, 5 Drawing Sheets

100
110
114
120
112
3b
3c

CORDLOCK

FIELD

This invention relates to hollow mobility canes. In particular, this invention relates to hollow mobility canes with interchangeable tips.

BACKGROUND

Mobility canes have a tip for contacting the ground. The tip is a consumable item that wears with use, requiring replacement by the end user.

Typically, an elastic shock cord runs through the hollow body of a cane, fixed at a handle end of the cane and attached to the tip at the opposite tip end of the cane. For instance, the tip may have a hook to attach to a loop in an end of the cord. When the tip is in position on the tip end of the cane, the elastic cord is in tension applying a bias to keep the tip in position. Commonly, the hollow body of a mobility cane may be made up of a plurality of segments that inter-fit to provide a long cane when in use, and may be separated to provide for a compact bundle when not in use. The cord may serve the dual purpose of retaining the tip and maintaining a bias on the segments to keep them in a fixed inter-fit relationship during use.

With use, tips may wear out. In order to change a tip, a user first pulls the tip out of the tip end of the cane, stretching the elastic cord attached to the tip. A tool, such as a finger or pencil, is often inserted into the loop to ensure that the cord does not retract back into the cane tube while the tip is being changed. This may be an awkward process, especially for a visually impaired user. If the cord does retract back into the cane tube, it is difficult to retrieve the loop without a special tool, rendering the cane inoperative and in need of repair. For this reason, many users are reluctant to attempt tip changes on their own and are forced to recruit the assistance of a sighted friend.

BRIEF DESCRIPTION OF THE DRAWINGS

In drawings which illustrate embodiments by way of example only.

DETAILED DESCRIPTION

In an implementation, a cordlock is provided for retaining an opening end of an elastic cord beyond an opening of a hollow mobility cane. The cane having an inner diameter defined by an inner wall. The cord sized to fit within the inner diameter, extending through the cane from a fixed cord end, attached at the opening end to a cane tip, and including a widened portion at the opening end. The cord in tension when the opening end of the cord is drawn past the opening. The cordlock may comprise a body having: a length greater than the inner diameter, a width less than the inner diameter, a depth less than the inner diameter, a body opening extending through the depth and sized to accommodate the cord but to prevent passage of the widened portion, the depth sized to accommodate the cord between the body and the inner wall when the cordlock is inserted in the cane.

In an aspect, the cordlock may further comprise at least one rib extending the depth of the body and extending along at least a portion of the length adjacent to the body opening. The at least one rib may comprise a pair of ribs on opposite sides of the body opening. The cord may be retained between the ribs when inserted in the cane. In an aspect, the rib may extend the depth on both sides of the body. The rib may extend to an apex at about a mid portion of the rib, and tapers to a minimum height at ends of the rib. The rib may taper continuously from the minimum width to the apex. The rib may extend along the entire length of the body. The rib may extend along a portion of the width of the body. The rib may extend about a periphery of the body. The portion may comprise an end of the body. In an aspect the body opening may be substantially centrally located along the length and width of the body.

In an embodiment a mobility cane may be provided. The cane may comprise at least one elongated hollow member having a handle end for holding by a user and a tip end; a cane tip for attachment to the tip end and adapted to contact the ground when the cane is in use; an elastic cord for attaching to the cane tip at a first end, and for attaching to the handle end at a second end, the elastic cord adapted to impart a bias on the cane tip to attach it to the tip end during use, the first end having a widened portion sized larger than a diameter of the elastic cord; a cordlock comprising a body, the body having a length greater than an inner diameter of the cane, a width less than the inner diameter and a depth less than the inner diameter of the cane, the body further comprising an opening through the depth, the opening sized to accommodate the cord and sized to prevent passage of the widened portion. The cane may further comprise the cordlock as described above.

Figure 1A:
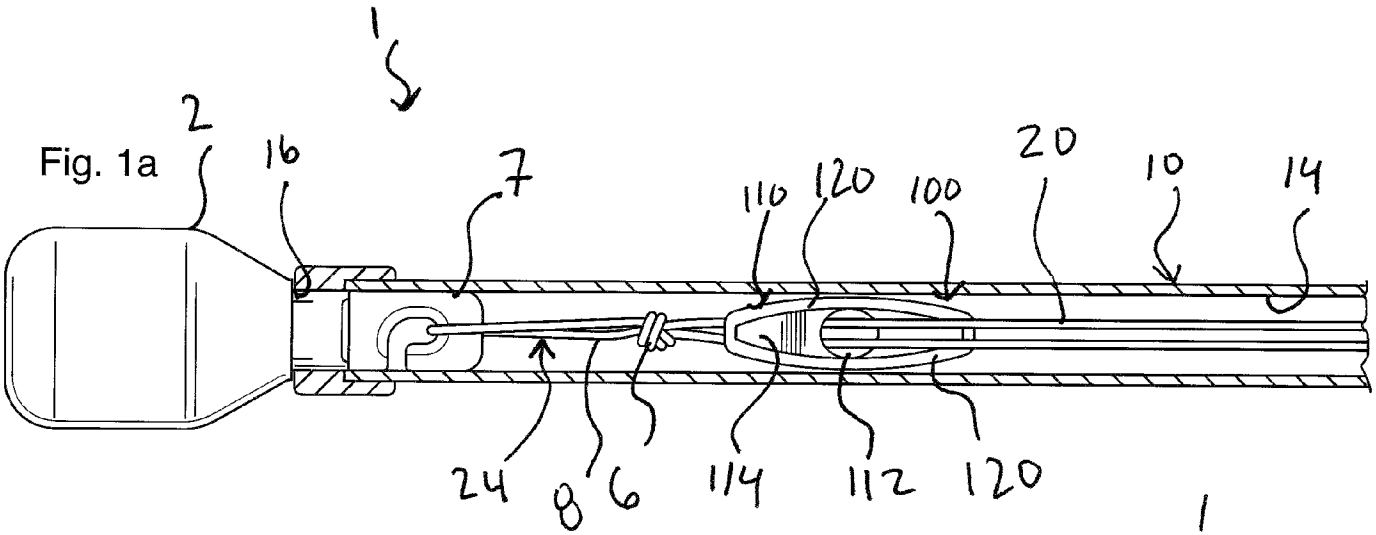
FIG. 1*a* is a sectional view of an opening end of a hollow mobility cane in a closed position.
Figure 1B:
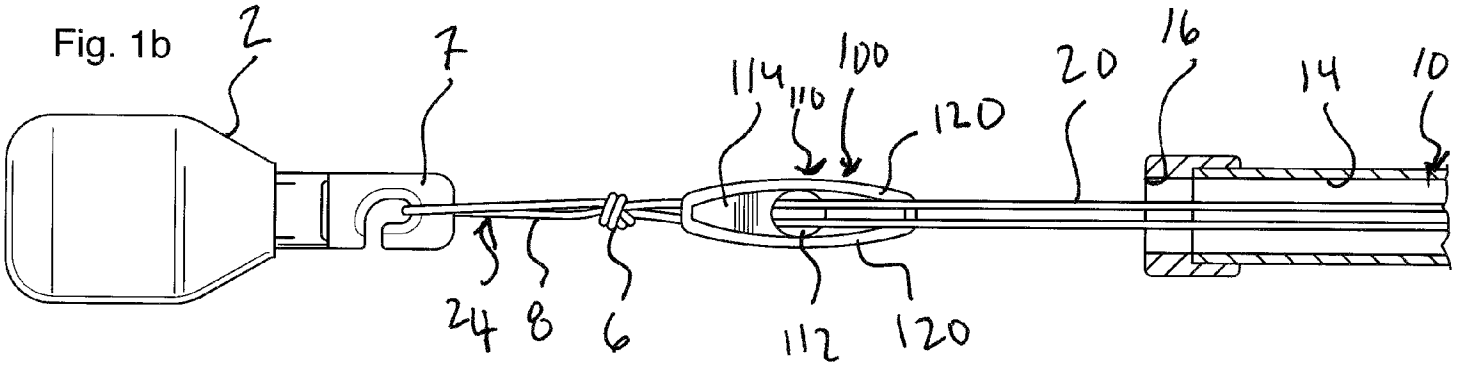
FIG. 1*b* is a sectional view of the opening end of the hollow mobility cane of FIG. 1*a* in an opening position.
Figure 1C:
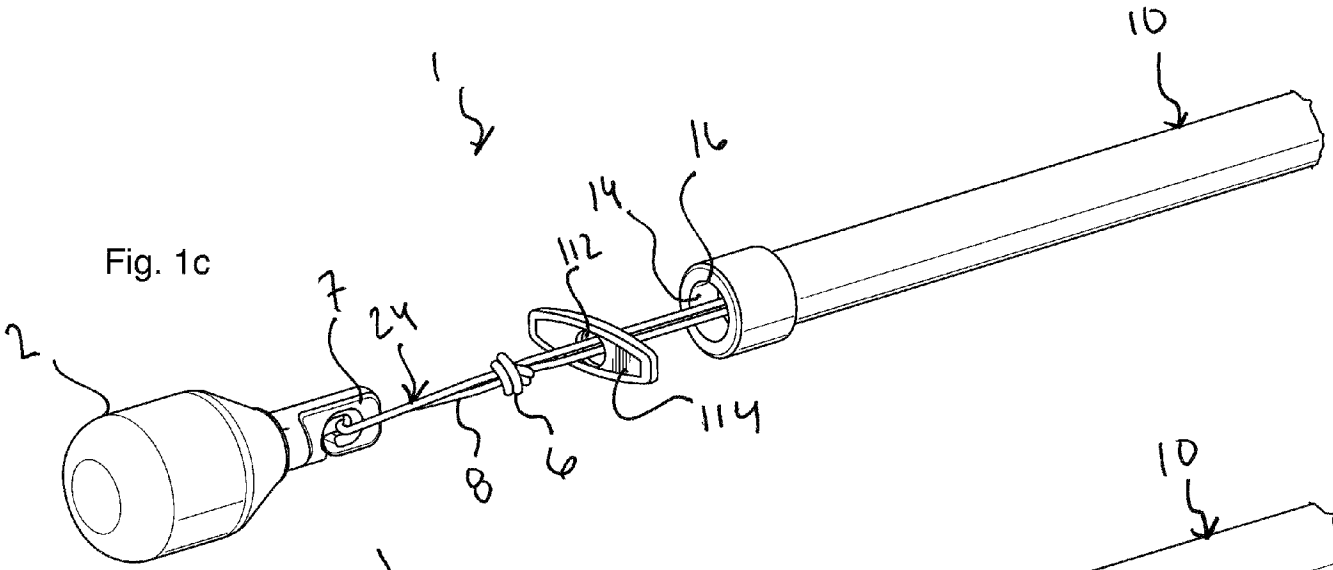
FIG. 1 *c* is an isometric view of the opening end of the hollow mobility cane of FIG. 1*a* in an open position.
FIG. 1*d* is an isometric view of the opening end of the hollow mobility cane of FIG. 1*a* in an retained position.
Figure 1D:
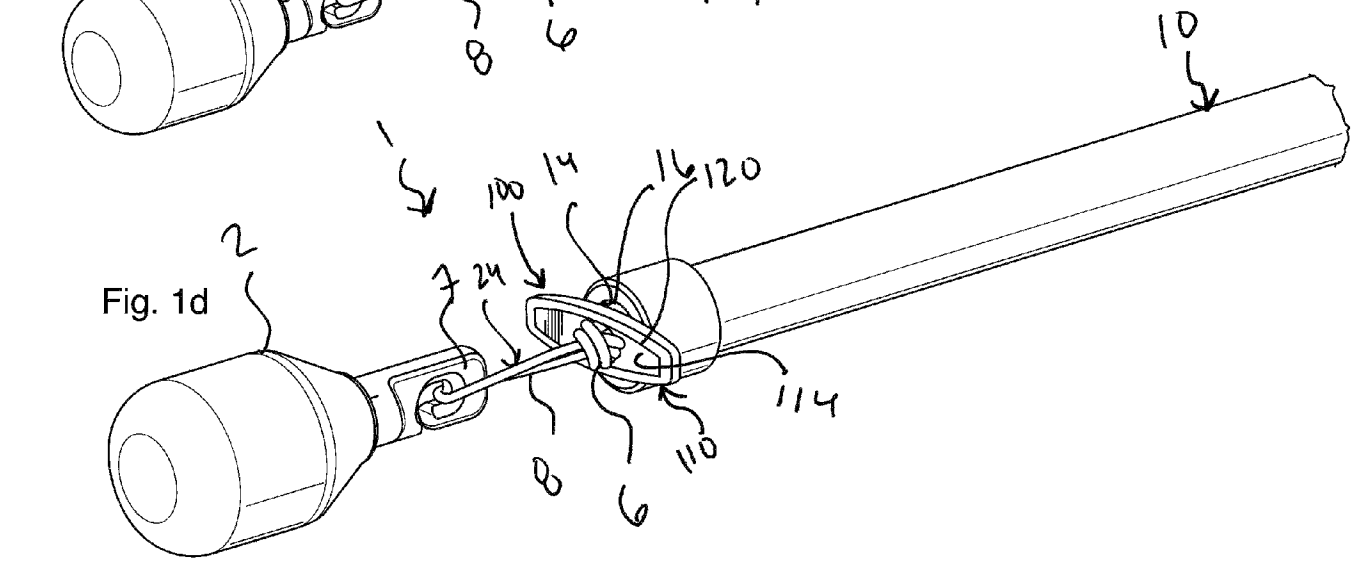

Referring to FIGS. 1*a*-1*d* and 2*a*-2*d*, a hollow mobility cane 1 is illustrated. FIGS. 1*a* and 1*b* illustrate a side section view of a tip end of the cane 1. FIG. 1*a* illustrates the tip 2 in position on an opening 16 of the cane 1. FIG. 1*b* illustrates the tip 2 in an extended position from the opening 16. A cordlock 100 is illustrated in-line with an elastic cord 20 that extends through the cane 1 to retain the tip 2 in place during use. FIGS. 1*c* and 1*d* are isometric views of the tip end of the cane 1 with the cordlock 100 rotated 90 degrees from FIGS. 1*a* and 1*b* such that the cordlock 100 acts as a stopper to prevent a widened portion 6 of cord 20, a knot in the implementation of the figures, from passing through an opening 112 in the cordlock 100.

Referring to FIGS. 2*a*-*d*, a full view of a segmented mobility cane 1 with a cordlock 100 is illustrated in section views. FIGS. 2*a*-2*d* illustrate the same sequence of views illustrated in FIGS. 1*a*-*d*, but with reference to the whole cane 1. The fixed end 22 of the cord 20 is illustrated in these Figures. In addition to holding the tip 2 in place, the cord 20 provides a bias to secure the segments of the cane 1 in position during use.

Figure 2A:
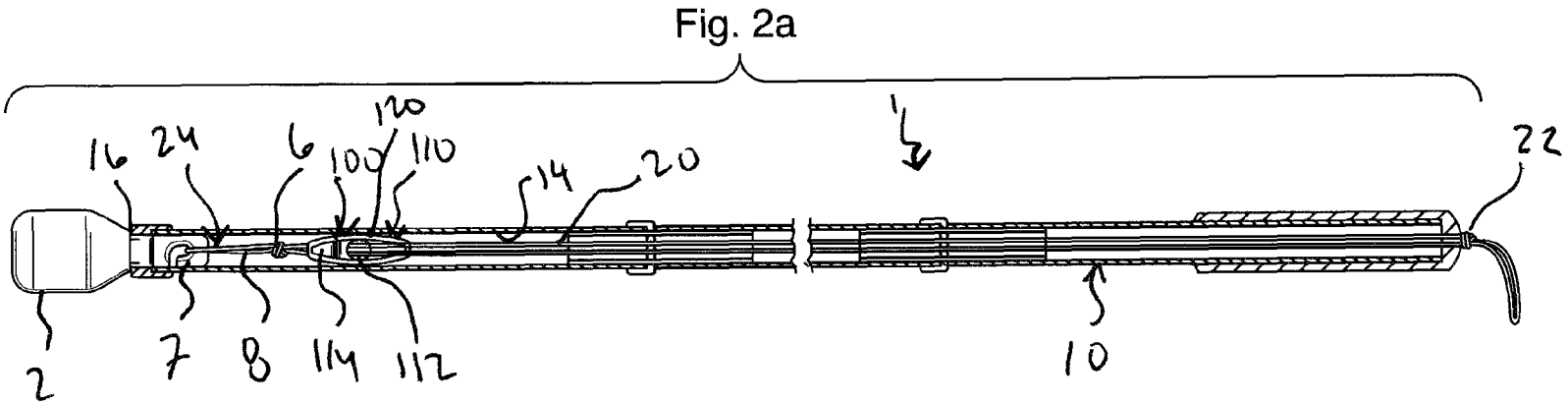
FIG. 2*a* is a sectional view of a hollow mobility cane in a closed position.
Figure 2B:
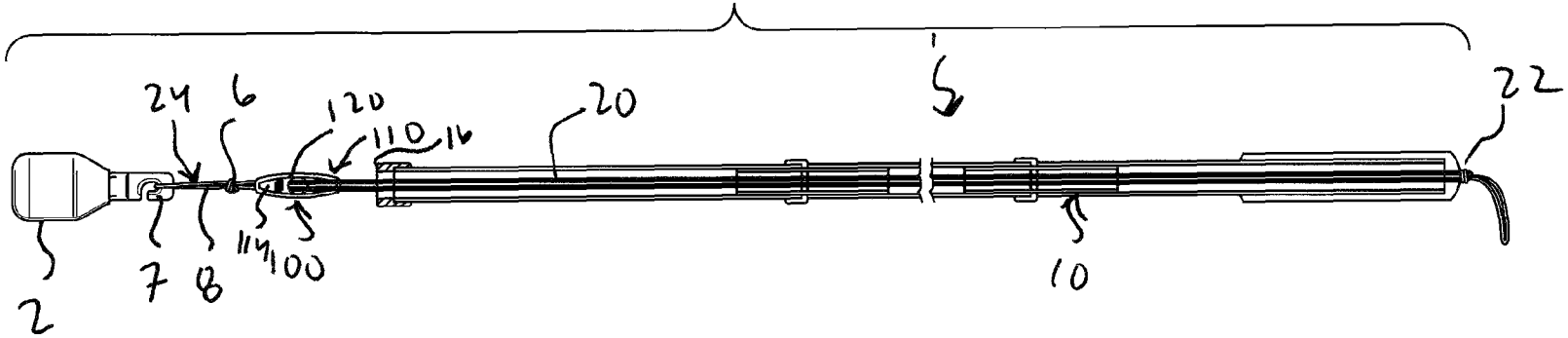
FIG. 2*b* is a sectional view of the hollow mobility cane of FIG. 2*a* in an opening position.
Figure 2C:
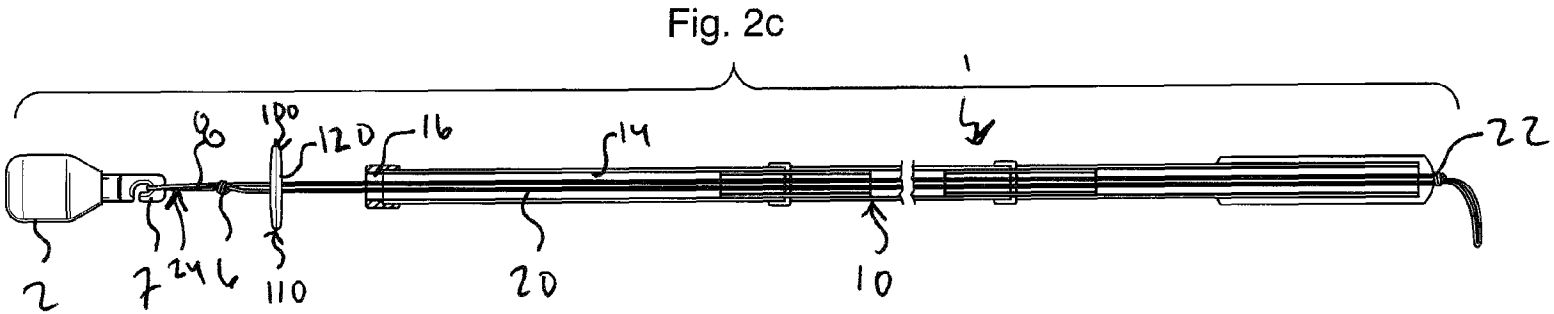
FIG. 2*c* is a sectional view of the hollow mobility cane of FIG. 2*a* in an open position.
Figure 2D:
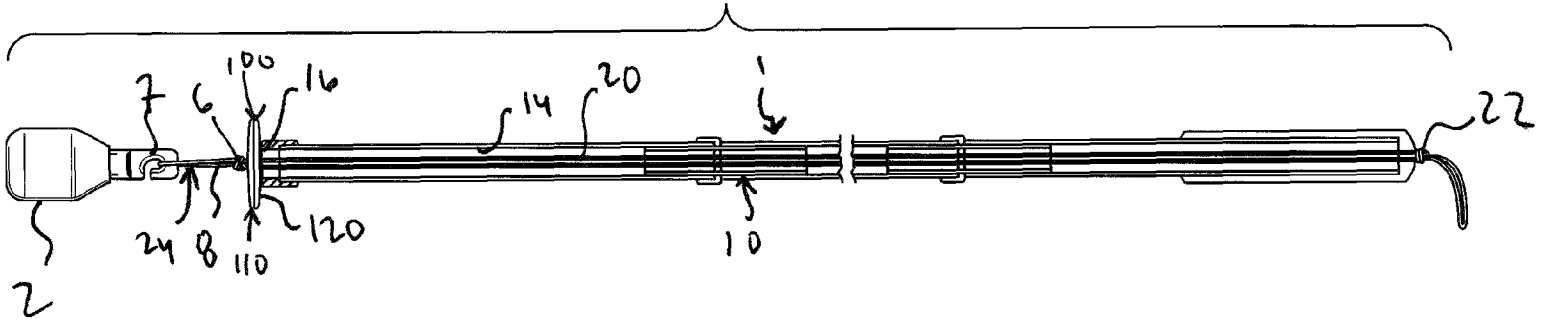
FIG. 2*d* is a sectional view of the hollow mobility cane of FIG. 2*a* in an retained position.
Figures 3A, 3B, 3C:
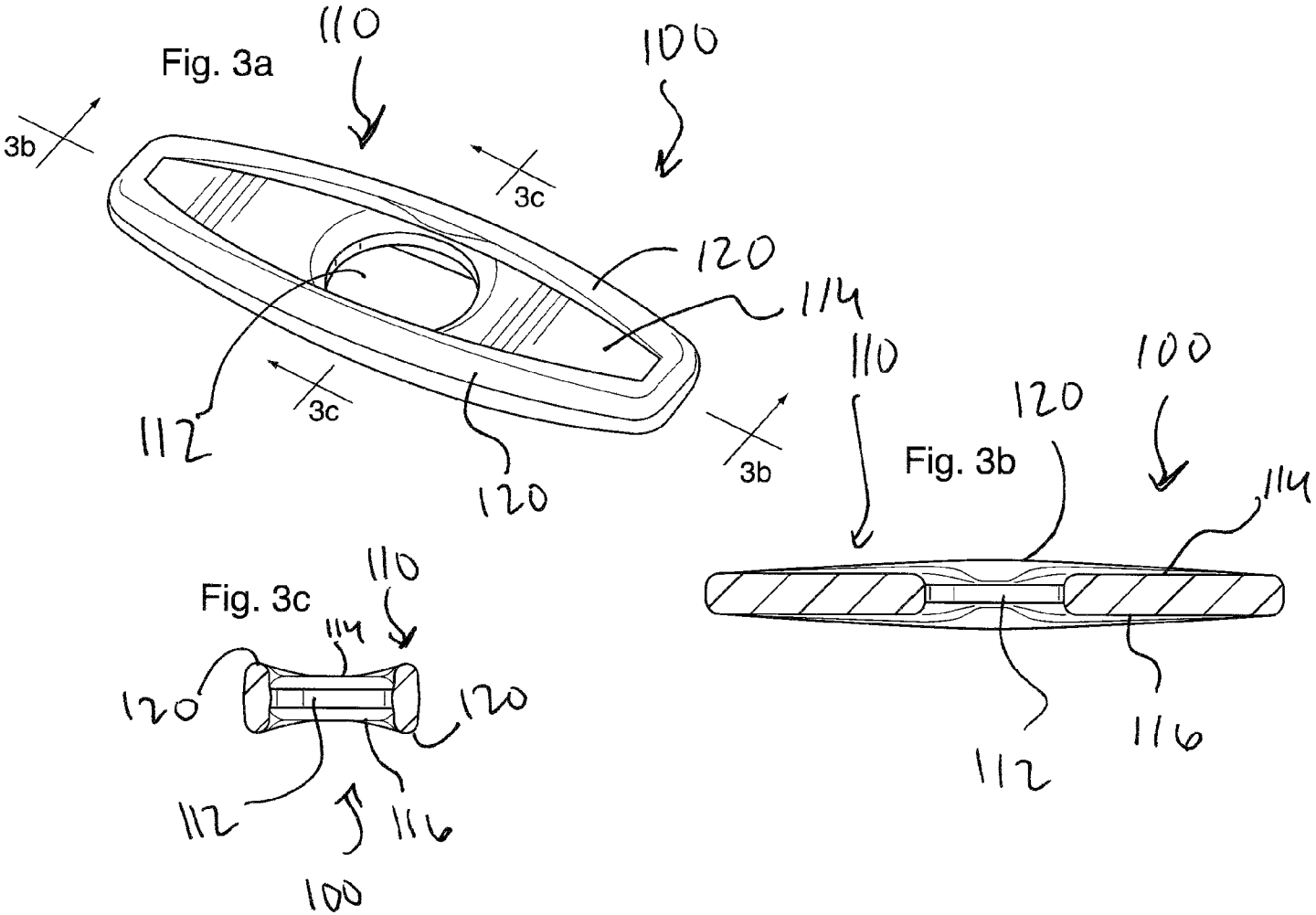
FIG. 3*a* is an isometric view of a cordlock.
FIG. 3*b* is sectional view of the cordlock of FIG. 3*a* taken along the line 3*b*-3*b*.
FIG. 3*c* is sectional view of the cordlock of FIG. 3*a* taken along the line 3*c*-3*c*.

FIGS. 3*a*-3*c* illustrate in isolation an embodiment of the cordlock 100 illustrated in FIGS. 1*a*-*d* and 2*a*-*d*.

Referring to FIG. 1*a*, a cordlock 100 is illustrated disposed within a mobility cane 1. The cane 1 consisting of at least one tube 10. An elastic shock cord 20 extends through the tube 10 and is attached to a tip 2 that is secured over an opening 16 of the tube 10 by the cord 20. The cordlock 100 includes an opening 112 that is sized to accommodate the cord 20, but also sized to prevent passage of a widened portion 6 of the cord 20. The widened portion 6 is shown as a knot in the Figures, but could be an alternative widening, such as a fastener secured over the cord 20. The cane 1, cord 20 and tip 2 may be constructed as known in the art. The cordlock 100 may be constructed of a suitable material such as metal or plastic. In an implementation, the cordlock 100 comprises injection molded plastic.

The tube 10 has an inner diameter defined by a tube inner wall 14. The cord 20 extends through the tube 10 from a fixed cord end 22, not shown in this Figure, and is constrained by the tube inner wall 14. The cord 20 is in tension when the opening end 24 is attached to the tip 2, imparting a bias towards the fixed cord end 22. In the embodiment illustrated in the Figures, the cord 20 is shown as a double stranded loop with a widened portion 6 that is a knot which forms a loop 8 at the opening end 24 of the cord 20. The skilled person will appreciate that the cord 20 may be other than double stranded, for example single stranded, and that in place of a loop 8, an alternative attachment means may be used such as a hook or eye.

The cordlock 100 has a body 110 having a length and width, and a body opening 112 in the broad faces 114, 116 of the body 110 that extends through the thickness or depth of the cordlock 100. In the implementation illustrated, the body opening 112 is generally central in the faces 114, 116 and is shown as being substantially circular. The opening 112 is sized to accommodate the cord 20, but to prevent passage of the widened portion 6, illustrated as a knot.

The body of the cordlock 110 is configured to fit lengthwise in the tube 10. In particular, the body 110 has a length greater than the inner diameter of the tube 10, a width less than the inner diameter, and a depth less than the inner diameter. In the illustrated embodiments, the width tapers along the length from a middle portion of the body 110 to first and second end portions of the body.

The thickness or depth of the body 110 is selected to accommodate the cord 20 between a face 114, 116 of the body 110 and the inner wall 14 when the cordlock 100 is inserted in the tube 10. In particular, and as shown in FIGS. 1*a* and 2*a*, the cord 20 fits between one of the body faces 114 and 116 and the inner wall 14 on one side of the opening 112 and between the other body face 114 and 116 and the inner wall 14 on the other side of the opening 112.

Referring to FIGS. 3*a*-3*c*, a perspective view FIG. 3*a*, a lengthwise section view FIG. 3*b*, and widthwise section view FIG. 3*c*, illustrate an implementation of the cordlock 100. A seen in FIGS. 3*a*-3*c*, the body 110 may have at least one rib 120 extending the depth of the body 110, and extending at least a portion of the length adjacent to the body opening. As illustrated in this implementation the at least one rib 120 is a pair of ribs 120 that extend the depth on the first body face 114 and second body face 116 and extend along at least a portion of the periphery of the length on opposite sides of the body opening 112. The ribs 120 provide additional strength to the cordlock 100, which is adapted to provide a minimal depth in the center portion of the body 110 to accommodate the cord 20, to allow the cordlock 100 to perform its function. In the embodiment illustrated, the cordlock 100 has two ribs 120 that extend from the first body face 114 and the second body face 116. In the illustrated embodiment, the ribs 120 have an apex about a middle portion of the length and taper along the length from the apex. In some embodiments the ribs may extend the entire length of the body 110, or may only extend a portion of the length of the body 110. In the embodiment illustrated a rib 120 is provided that extends about the periphery of the body 110, from an apex at a middle portion of the body 110 to a minimum depth at the ends of the body 110.

Referring again to FIGS. 1*a* and 2*a*, when the tip 2 is in position, the cord 20 is threaded through the opening 112 of the body 110 and the cordlock 100 is positioned along the cord 20 between the widened portion 6 and the fixed cord end 22. In the embodiment illustrated, the loop 8 is connected to the tip 2 via a hooking member 7 on the tip 2. The hooking member 7 may be any means of grasping the loop 8, for example a hook. The cordlock 100 and the cord 20 are inserted into the tube 10 such that the tip 2 is in contact with the tube opening 16. In this position, the cane 1 is ready to be used by the user.

Referring to FIG. 1*b*, to change the tip 2, the tip 2 is pulled away from the tube 10 such that the widened portion 6 and the cordlock 100 are extracted from the tube 10. When extracted, the cordlock 100 rotates from the in-line position illustrated in FIG. 1*b* to an out-of-line position illustrated in FIG. 1*b*. As illustrated in FIG. 1*d*, upon release of the tip 2 by the user, the cord 20 retracts into the cane 1 until the cordlock 100 contacts the cane 1 and stops the widened portion 6 from entering the opening 16 of the cane 1.

The user may then exchange the tip 2 without concern that the opening end 24 of the cord 20 will retract into the cane 1. Once the new tip 2 is in place, the user may draw on the cord and align the cordlock 100 with the opening 16. Releasing the tip 2 with the cordlock 100 aligned will allow the cordlock 100 and the widened portion 6 to retract into the cane 1 and locate the tip 2 in position for use as illustrated in FIG. 1*a*.

Various embodiments of the present invention having been thus described in detail by way of example, it will be apparent to those skilled in the art that variations and modifications may be made without departing from the invention. The invention includes all such variations and modifications as fall within the scope of the appended claims.

The invention claimed is:

1. A cordlock for retaining an opening end of an elastic cord beyond an opening of a hollow mobility cane, the cane having an inner diameter defined by an inner wall, the cord sized to fit within the inner diameter, the cord extending through the cane from a fixed cord end, attached at the opening end to a cane tip, and including a widened portion at the opening end, the cord in tension when the opening end of the cord is drawn past the opening, the cordlock comprising:

a body having:

a length greater than the inner diameter, a width less than the inner diameter, a depth less than the inner diameter, a body opening extending through the depth and sized to accommodate the cord but to prevent passage of the widened portion, and, the depth sized to accommodate the cord between the body and the inner wall when the cordlock is inserted in the cane through the opening.

2. The cordlock of claim 1 further comprising at least one rib extending the depth of the body and extending along at least a portion of the length adjacent to the body opening.

3. The cordlock of claim 2 wherein said at least one rib comprises a pair of ribs on opposite sides of the body opening.

4. The cordlock of claim 3 wherein the cord is retained between the ribs when inserted in the cane.

5. The cordlock of claim 2 wherein the rib extends the depth on both sides of the body.

6. The cordlock of claim 1 wherein the body opening is substantially centrally located along the length and width of the body.

7. The cordlock of any claim 2 wherein the at least one rib extends to an apex at about a mid portion of the rib, and tapers to a minimum height at ends of the rib.

8. The cordlock of claim 7 wherein the at least one rib tapers continuously from the minimum width to the apex.

9. The cordlock of claim 8 wherein the at least one rib extends along the entire length of the body.

10. The cordlock of claim 2 wherein the at least one rib extends along a portion of the width of the body.

11. The cordlock of claim 10 wherein the portion comprises an end of the body.

12. The cordlock of claim 2 wherein the at least one rib extends about a periphery of the body.

13. A mobility cane comprising:

at least one elongated hollow member having a handle end for holding by a user and a tip end;

a cane tip for attachment to the tip end and adapted to contact the ground when the cane is in use;

an elastic cord for attaching to the cane tip at a first end, and for attaching to the handle end at a second end, the elastic cord adapted to impart a bias on the cane tip to attach it to the tip end during use, the first end having a widened portion sized larger than a diameter of the elastic cord; and, a cordlock comprising a body, the body having a length greater than an inner diameter of the cane, a width less than the inner diameter and a depth less than the inner diameter of the cane, the body further comprising an opening through the depth, the opening sized to accommodate the cord and sized to prevent passage of the widened portion.

14. The cane of claim 13 further comprising at least one rib extending the depth of the body and extending along at least a portion of the length adjacent to the body opening.

15. The cane of claim 14 wherein said at least one rib comprises a pair of ribs on opposite sides of the body opening.

16. The cane of claim 15 wherein the cord is retained between the ribs when inserted in the cane.

17. The cane of claim 13 wherein the body opening is substantially centrally located along the length and width of the body.

18. The cane of any claim 14 wherein the at least one rib extends to an apex at about a mid portion of the rib, and tapers to a minimum height at ends of the rib.

19. The cane of claim 14 wherein the at least one rib extends along the entire length of the body.

20. The cane of claim 14 wherein the at least one rib extends about a periphery of the body.

* * * * *